US008291828B2

(12) United States Patent
Glasser

(10) Patent No.: US 8,291,828 B2
(45) Date of Patent: Oct. 23, 2012

(54) HIGH VELOCITY AMMUNITION ROUND

(76) Inventor: Alan Z. Glasser, Cumberland, MD (US)

( * ) Notice: Subject to any disclaimer, the term of this patent is extended or adjusted under 35 U.S.C. 154(b) by 0 days.

(21) Appl. No.: 13/208,619

(22) Filed: Aug. 12, 2011

(65) Prior Publication Data

US 2011/0308417 A1 Dec. 22, 2011

Related U.S. Application Data

(63) Continuation-in-part of application No. 12/660,802, filed on Mar. 4, 2010, now Pat. No. 8,096,243.

(51) Int. Cl.
*F42B 12/00* (2006.01)

(52) U.S. Cl. ..... 102/501; 102/517; 102/703

(58) Field of Classification Search ..... 102/501, 102/517–523, 703, 400; 244/3.27, 3.28, 244/3.24

See application file for complete search history.

(56) References Cited

U.S. PATENT DOCUMENTS

| | | | | |
|---|---|---|---|---|
| 609,003 | A * | 8/1898 | Borelli | 244/3.27 |
| 724,326 | A * | 3/1903 | Pepperling | 102/400 |
| 1,243,542 | A | 10/1917 | Moore | |
| 3,545,383 | A | 12/1970 | Lucy | |
| 3,568,954 | A | 3/1971 | McCorkle, Jr. | |
| 3,745,926 | A | 7/1973 | Mertz et al. | |
| 3,880,083 | A | 4/1975 | Wasserman et al. | |
| 3,968,945 | A | 7/1976 | Walton | |
| 4,075,946 | A | 2/1978 | Deffayet et al. | |
| 4,109,582 | A | 8/1978 | Haep et al. | |
| 4,213,393 | A | 7/1980 | Gunners et al. | |
| 4,408,538 | A | 10/1983 | Deffayet et al. | |
| 4,638,738 | A | 1/1987 | Bisping et al. | |
| 4,638,739 | A | 1/1987 | Sayles | |
| 4,671,181 | A | 6/1987 | Romer et al. | |
| 4,677,915 | A | 7/1987 | Boecker et al. | |
| 4,716,834 | A * | 1/1988 | Wallow et al. | 102/519 |
| 4,753,172 | A | 6/1988 | Katzmann et al. | |

(Continued)

FOREIGN PATENT DOCUMENTS

EP 0073385 A1 3/1983

OTHER PUBLICATIONS

Spencer, Jr.; NASA Technical Note NASA TN D-4079; Hypersonic Aerodynamic Characteristics of Minimum-Wave-Drag Bodies Having Variations in Cross-Sectional Shape; Sep. 1967.

(Continued)

*Primary Examiner* — Jonathan C Weber
(74) *Attorney, Agent, or Firm* — Wiggin and Dana LLP

(57) ABSTRACT

A sub-caliber bullet with an aerodynamic shape has long-range accuracy due to a high muzzle velocity and reduced time of flight to a target. The bullet has forward and aft portions and a mid-portion. The forward portion has a density in excess of 10/cm$^3$ while the mid-portion has a lower density. The bullet has an aspect ratio of at least 5:1 and a diameter, d, that satisfies a Power Law equation:

$$d=D*(x/L)^n$$

where D is a maximum bullet diameter, L is the length, x is a distance rearward from a nose of the bullet and n is a Power Law exponent that is between 0.5 and 0.75. In some embodiments, a blind bore extends into the mid-portion from the aft portion and a sustainer propellant within the bore ignites as the bullet exits a gun muzzle to provide a velocity boost and to overcome aerodynamic drag.

20 Claims, 12 Drawing Sheets

U.S. PATENT DOCUMENTS

| | | | |
|---|---|---|---|
| 4,836,108 | A | 6/1989 | Kegel et al. |
| 4,850,280 | A | 7/1989 | Wallow et al. |
| 4,872,409 | A | 10/1989 | Becker et al. |
| 4,961,384 | A | 10/1990 | Sayles |
| 5,069,869 | A | 12/1991 | Nicolas et al. |
| 5,162,607 | A | 11/1992 | Steiner |
| 5,164,540 | A | 11/1992 | Chiarelli et al. |
| 5,297,492 | A | 3/1994 | Buc |
| 5,299,501 | A | 4/1994 | Anderson |
| 5,368,254 | A | 11/1994 | Wickholm |
| 5,413,049 | A | 5/1995 | Feldmann et al. |
| 5,477,786 | A | 12/1995 | Leeker et al. |
| 5,481,981 | A | 1/1996 | Sippel et al. |
| 5,494,239 | A | 2/1996 | Giacomel |
| 5,798,478 | A | 8/1998 | Beal |
| 5,811,788 | A | 9/1998 | Wicke |
| 5,834,684 | A | 11/1998 | Taylor |
| 5,936,191 | A | 8/1999 | Bisping et al. |
| 6,070,532 | A | 6/2000 | Halverson |
| 6,085,660 | A | 7/2000 | Campoli et al. |
| 1,938 | A1 | 2/2001 | Harkins et al. |
| 6,240,849 | B1 | 6/2001 | Holler |
| 6,305,293 | B1 | 10/2001 | Fry et al. |
| 6,662,726 | B1 | 12/2003 | Steiner |
| 6,721,682 | B1 | 4/2004 | Moore et al. |
| 7,036,433 | B2 | 5/2006 | Beal |
| 7,150,233 | B1 | 12/2006 | Eberhart |
| 7,526,988 | B2 | 5/2009 | Elder |
| 7,568,433 | B1 | 8/2009 | Farina et al. |
| 7,849,800 | B2 | 12/2010 | Hinsdale et al. |
| 2002/0112639 | A1 | 8/2002 | Jensen |
| 2004/0016357 | A1 | 1/2004 | Beal |
| 2007/0261543 | A1 | 11/2007 | Elder |
| 2009/0096687 | A1 | 4/2009 | Gentilman et al. |
| 2009/0193996 | A1 | 8/2009 | Brydges-Price |

OTHER PUBLICATIONS

Crowell, Sr., Gary A.; "The Descriptive Geometry of Nose Cones"; Copyright 1996 http://www.if.sc.usp.br/~projetsulfos/artigos/NoseCone_EQN2.PDF.

Santos, J.; Braz. Soc. of Mech. Sci. & Eng.; Leading-Edge Bluntness Effects on Aerodynamic Heating and Drag of Power Law Body in Low-Density Hypersonic Flow; vol. XXV!!, No. 3; Jul. 2005.

PCT/US2011/021232; International Search Report; Nov. 25, 2011.

* cited by examiner

| Parameter | .308 Bullet with Sustainer | .308 Bullet without Sustainer | Conventional .308 Bullet | Conventional .300 Bullet | Conventional .338 Bullet | Conventional 50 Cal Bullet |
|---|---|---|---|---|---|---|
| Bullet | .175 inch dia, .67 Power Law Profile | .175 inch dia, .67 Power Law Profile | Winchester Sierra Match King 175 gr. HPBT | Winchester Win Mag Sierra Match King 220 gr. HPBT | Lapua Magnum GB528 300 gr. HPBT | |
| Effective Range | 1.5 km | 1.2 km | 1 km | 1 km | 1.2 km | 1.5 km |
| Impact Velocity at Effective Range | 3500 ft/s | 1860 ft/s | 1060 ft/s | 1447 ft/s | 1381 ft/s | 1170 ft/s |
| In-Bore Weight | 56 gr. | 56 gr. | 175 gr. | 220 gr. | 300 gr. | 647 gr. |
| Bullet Weight | 40 gr. | 40 gr. | 175 gr. | 220 gr. | 300 gr. | 647 gr. |
| Time of Flight Effective Range | 1.2 s | 1.4 s | 2.1 s | 1.62 s | 2.0 s | 2.74 s |
| Time of Flight to 1 km | 0.81 s | 1.08 s | 2.1 s | 1.62 s | 1.52 s | ND |
| Bullet Drop at 1 km | 59 inch | 104 inch | 400 inch | 235 inch | 208 inch | ND |
| Velocity at 1 km | 4000 ft/s | 2199 ft/s | 1027 ft/s | 1447 ft/s | 1634 ft/s | ND |
| Drag Coefficient | 0.122 after sustainer burn | .122-.230 | .224-420 | .292-.355 | .280-.336 | .70 |
| Muzzle Velocity | 4000 ft/s | 4000 ft/s | 2580 ft/s | 2850 ft/s | 2850 ft/s | 2910 ft/s |
| Armor (RHS) Penetration | 18 mm @ 1.5 km | ND | ND | ND | ND | 13 mm @ 0.75 km |

HPBT = Hollow Point Boat Tail
ND = Not Determined
Drag Coefficient varies with velocity
RHS = Rolled Homogeneous Steel

FIG.15

| Projectile | | | | | Sabot | | Impact | | | Crater | | | E/V |
|---|---|---|---|---|---|---|---|---|---|---|---|---|---|
| Shot No. | Type | L (mm) | D (mm) | M (g) | Wall Thickness (mm) | Mass (g) | V (m/s) | E (kJ) | Yaw (deg) | P (mm) | H (mm) | Vol (ml) | (kJ/ml) |
| 1 | Mixture $\rho = 1.13$ | 102 | 30 | 84 | 4 | 80 | 1935 | see notes | 0.3 | 5 | 40 | 6.2 | see notes |
| 2 | Mixture $\rho = 1.90$ | 102 | 24 | 84 | 7 | 107 | 1986 | see notes | 0.3 | 20 | 72 | 41.0 | see notes |
| 3 | Mixture $\rho = 2.71$ | 102 | 20 | 84 | 9 | 119 | 1999 | 167.8 | 0.4 | 32 | 62 | 61.0 | 2.8 |
| 4 | Mixture $\rho = 4.21$ | 102 | 16 | 84 | 11 | 129 | 2018 | see notes | 0.9 | 17 | 58 | 41.0 | see notes |
| 5 | Aluminum $\rho = 2.80$ | 101.5 | 19.5 | 85.3 | 9.3 | 123.7 | 2001 | 170.8 | 0.6 | 33 | 57 | 58.0 | 2.9 |

Notes:

Aluminum is 6061-T6.

Target is Rolled Homogeneous Armor (RHA), 200 mm by 200 mm by 150 mm thick, with nominal Brinell Hardness Number (BHN) 269.

Shot No. 1: Front of mixture significantly deformed and shortened due to aerodynamic forces.
Shot No. 2: Slight deformation and possible fracture of front of mixture.
Shot No. 3: Slight deformation / fracture of front portion of mixture.
Shot No. 4: Significant mixture set-back and lateral expansion at rear, estimated line-of-sight length at impact is 50 mm.
Shot No. 5: Good impact.

FIG. 18

HIGH VELOCITY AMMUNITION ROUND

CROSS REFERENCE TO RELATED APPLICATIONS

This application is a continuation-in-part of U.S. application Ser. No. 12/660,802, filed Mar. 4, 2010, the disclosure of which is incorporated herein by reference in its entirety.

BACKGROUND

1. Field of the Disclosure

Disclosed herein is a high velocity ammunition round that more particularly is sub-caliber with a high density forward portion and a lower density aft portion. Optionally, a sustainer propellant or a base-bleed propellant may be contained within the aft portion.

2. Description of the Related Art

A significant, and uncontrollable, source of error in the accuracy of a long range sniper round is wind. Other sources of error include the effect of gravity during a long time of flight, variations in gun powder charge and drag. Drag causes the bullet velocity to decrease which increases the time of flight to a target. Types of drag that act on a bullet are wave drag (the drag force resulting from aerodynamic shock waves), skin friction drag (the friction between the airstream and the surface of the projectile) and base drag (a vacuum effect at the back of the bullet).

U.S. Pat. No. 6,070,532, titled "High Accuracy Projectile", discloses a projectile having improved accuracy when fired over long ranges that is formed from a monolithic block of a copper alloy. U.S. Pat. No. 5,297,492, titled "Armor Piercing Fin-Stabilized Discarding Sabot Tracer Projectile", discloses an armor piercing projectile having a fin stabilized sub-caliber high density rod penetrator and a blind cavity extending inward from an aft end of the projectile. This blind cavity is filled with a tracer composition. Both U.S. Pat. Nos. 6,070,532 and 5,297,492 are incorporated by reference in their entireties herein.

BRIEF SUMMARY

A sub-caliber bullet with an aerodynamic shape has long-range accuracy due to a high muzzle velocity and reduced time of flight to a target. The bullet has a forward portion, a mid-portion and an aft portion. The forward portion has a density in excess of 10 g/cm$^3$ while the mid-portion has a lower density. In one embodiment, the bullet has an aspect ratio of at least 5:1 and a nose profile that satisfies a Power Law equation:

$$d=D*(x/L)^n$$

where d is the diameter at a point along the length L, D is a maximum bullet diameter, L is the length, x is a distance rearward from a nose of the bullet and n is a Power Law exponent that is between 0.5 and 0.75. The bullet also has a center of pressure and a center of gravity forward of the center of pressure; a blind bore extending into the mid-portion from the aft portion and containing a sustainer propellant; and a plurality of nozzles communicating the blind bore with the aft end of the bullet.

The aerodynamic properties of the sub-caliber bullet are enhanced when the Power Law exponent, n, is approximately 0.67 and the aspect ratio is approximately 10:1. Ballistic stability is enhanced by an aft portion that either has a boat tail, flat base configuration or has a plurality of outwardly and rearwardly extending whiskers symmetrically disposed about its circumference.

In certain embodiments, the bullet also includes an igniter in flame communication with the sustainer propellant. The igniter may include a gas contained within a compressible or malleable container. Compression of the igniter module due to a pressure increase when the gun is fired causes the gas temperature to rise. Release of the hot gas ignites the sustainer propellant at a desired time.

In other embodiments, the sub-caliber bullet includes a plurality of nozzles arranged symmetrically about the longitudinal axis of the bullet. Jets of gas, expelled via the nozzles by burning the sustainer propellant, intercept air flow past the bullet during flight and thereby provide aerodynamic shocks which create regions of high pressure on the surface of the bullet, which act as stabilizers without drag.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

FIG. 15 presents various calculated bullet parameters to compare an aerodynamic bullet as described herein with conventional bullets.

FIG. 18 presents results of target impact tests using projectiles embodying the disclosure.

Like reference numbers and designations in the various drawings indicated like elements.

DETAILED DESCRIPTION

As used herein, "small caliber" refers to a bullet or ammunition round capable of being fired from a hand-held weapon such as a rifle or a shotgun. As well as any ammunition referenced in the Army Technical Manual—TM 43-0001-27. Such a bullet or round has a maximum nominal diameter of 1.18 inch or 30 millimeters.

Figure 1:
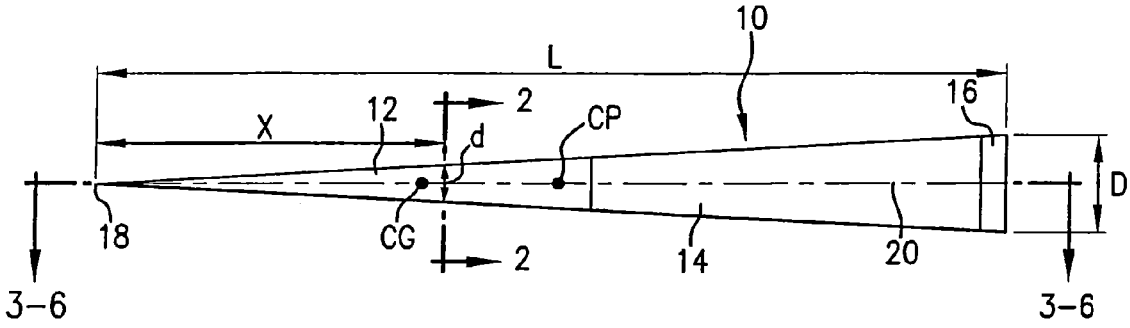
FIG. 1 is a planar view of a sub-caliber bullet as described herein.

FIG. 1 is a planar view of a sub-caliber bullet 10 that has long-range accuracy and is effective as a sniper round. As compared to a conventional bullet, the bullet 10 has a reduced mass to exit a muzzle at a higher initial velocity. The bullet 10 has an improved aerodynamic shape to reduce air resistance and thereby reaches a target quicker than the conventional bullet. Two advantages of a reduced time of flight are there is less time for a cross-wind to deflect the bullet and less time for the bullet trajectory to be influenced by gravity. The reduced flight time also attenuates error due to gunpowder charge variations. As the bullet takes less time to reach the target, there is less time for gravity to influence trajectory due to gunpowder variation caused velocity change.

The bullet 10 includes a forward portion 12, a mid-portion 14 and an aft portion 16. Forward portion 12 is formed from a material having a high density, preferably in excess of 16 g/cm$^3$, that resists deformation when exposed to aerodynamic heating. Suitable materials for the forward portion 12 include tungsten, tantalum and their alloys. Anti-armor penetrators act like fluids when they hit a target at hypersonic velocities. The density of the forward portion is therefore more significant than its structure. As a result, high density composite materials, such as tungsten particles embedded in a polymer matrix may be utilized. Certain embodiments may be suitable for a copper-jacketed lead forward portion 10. In these embodiments, the forward portion density may be as low as 10 g/cm$^3$.

The mid-portion 14 is formed from a high strength material having a density less than that of the forward portion 12 to move the center of gravity of the bullet 10 forward of the center of pressure.

Preferably, the mid-portion 14 is formed from steel. In some larger bullets, such as .50 cal or larger, the mid and aft bodies are made from carbon or glass composite. In some embodiments, as disclosed hereinbelow, the mid-portion 14 is hollow.

An aft portion 16 is formed from a high strength material having a density less than the density of the forward portion 12. Preferred materials for the aft portion are steel and reinforced polymer composites such as a glass or carbon-fiber filled polymer. The aft portion 16 improves aerodynamic stability by contributing to the movement of the center of gravity (CG) forward of the center of pressure (CP). In preferred embodiments, the center of gravity is separated by about 20% of the projectile length from the center of pressure. Aft portion features that contribute to aerodynamic stability may include a boat tail configuration and/or outwardly extending whiskers. At speeds above Mach 1.0, the whiskers create a low drag shock system that contributes to stability.

The bullet 10 has a high aspect ratio to enhance target penetration. Preferably, the aspect ratio, L:D where L is the bullet length and D is the maximum bullet diameter, is at least 5:1 and most preferably is about 10:1.

Figure 2:
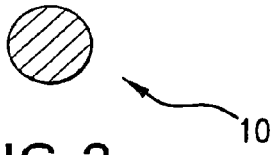
FIG. 2 is a latitudinal cross-sectional view of the sub-caliber bullet illustrated in FIG. 1.

The bullet profile is preferably established as a ⅔ power law body which has been shown to have superior aerodynamic stability and very low aerodynamic drag at hypersonic speeds. The diameter, d, at any point along the length of the bullet is determined by the equation:

$$d=D*(x/L)^n \quad (1)$$

where d, D and L have been defined above and x=a distance rearward of the bullet nose 18 along longitudinal axis 20. The power law exponent, n, ranges from 0.5 to 0.75. Preferably, n is ⅔ (0.67). The bullet 10 has symmetry about the longitudinal axis 20 such that at any point d, the latitudinal cross-section of the bullet is circular as shown in FIG. 2.

Figure 3:
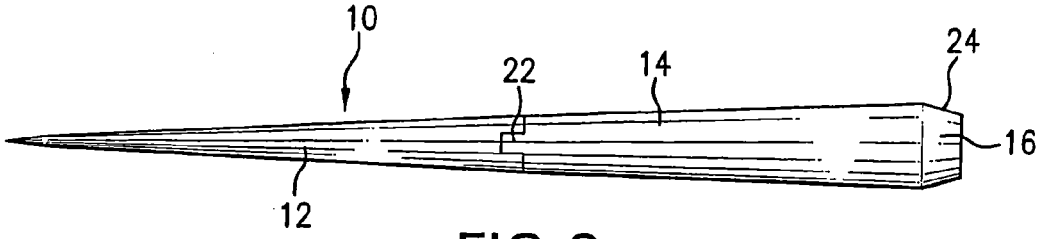
FIG. 3 is a longitudinal cross-sectional view of a first embodiment of the sub-caliber bullet illustrated in FIG. 1.

FIGS. 3-6 illustrate various embodiments of the sub-caliber bullet 10 in cross-sectional representation. In FIG. 3, the bullet 10 has the front portion joined to the mid-portion 14 by a projecting portion 22 that may be a threaded post or brazed rod. The aft portion 16 is formed as a portion of the mid-portion 14 and includes a boat tail 24.

Figure 4:
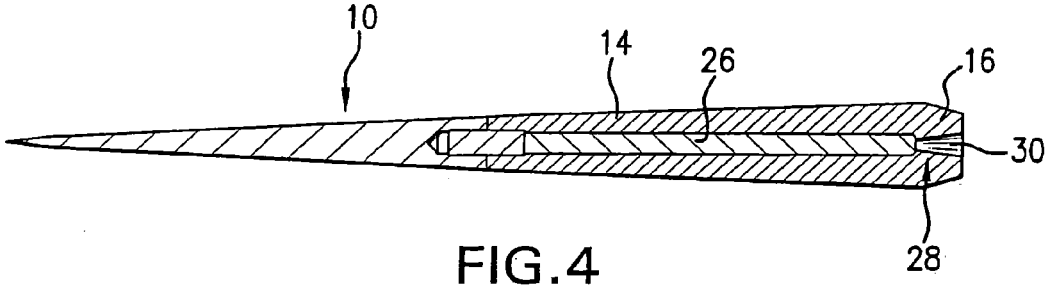
FIG. 4 is a longitudinal cross-sectional view of a second embodiment of the sub-caliber bullet illustrated in FIG. 1.

In FIG. 4, the mid-portion 14 of the bullet 10 includes a blind bore 26 that is open at the aft portion 16. The blind bore 26 has a substantially constant cross-sectional area through the mid-portion 14 that terminates at a restricted throat 28 adjacent the aft portion 16. The blind bore has diverging sidewalls through the aft portion forming a nozzle 30. The blind bore 26 is filled with a sustainer propellant that preferably ignites as the bullet leaves the muzzle of a gun, or very shortly before that moment, providing a drag canceling thrust to maintain or boost velocity.

A variation of the sustainer is the base-bleed where the propellant cancels or reduces only the base drag portion of the drag force.

Figure 5:
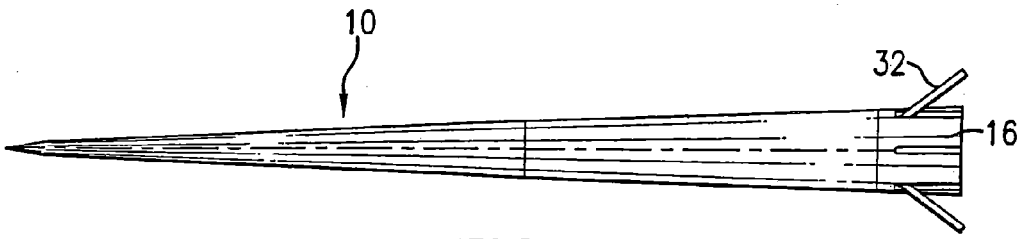
FIG. 5 is a longitudinal cross-sectional view of a third embodiment of the sub-caliber bullet illustrated in FIG. 1.

The bullet 10 illustrated in FIG. 5 includes whiskers 32 projecting outwardly and aftward from the aft portion 16. The whiskers, which are metal wires having a length of about one caliber and a gage of between 0.01 and 0.02 inch diameter are typically formed from heat resistant steel and provide aerodynamic stabilization without a need to spin the projectile. The whiskers move the center of pressure aftward increasing the separation between center of gravity and center of pressure improving aerodynamic stability in flight. A plurality of whiskers are symmetrically disposed around the circumference of the aft portion 16. For example, six whiskers may be disposed at 60° intervals about the circumference.

Figure 17:
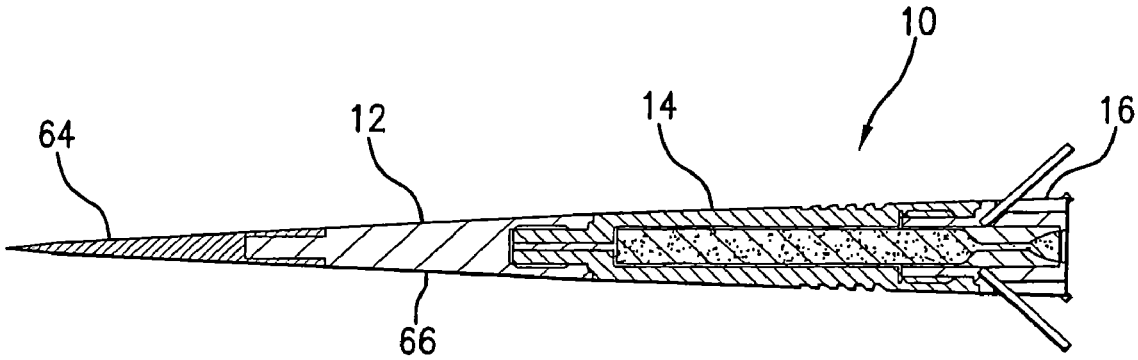
FIG. 17 is a cross-sectional view of a fifth embodiment of the sub-caliber bullet illustrated in FIG. 1.

The forward portion 12 of bullet 10 may have a combination of materials, as illustrated in FIG. 17. In this embodiment, forward portion 12 includes a tip section 64 formed from a material such as copper or aluminum. A high density rear section 66 of the forward portion 12 has sufficient volume that the overall density of the forward portion remains above 10 g/cm$^3$ and preferably above 16 g/cm$^3$ as described herein.

Figure 6:
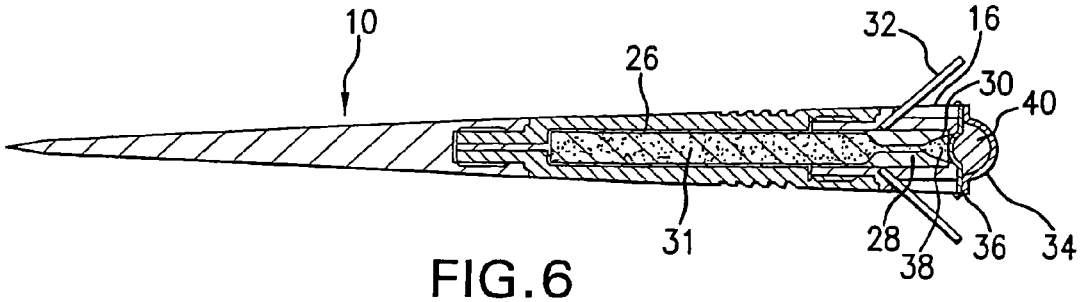
FIG. 6 is a longitudinal cross-sectional view of a fourth embodiment of the sub-caliber bullet illustrated in FIG. 1.

The bullet 10 illustrated in FIG. 6 combines whiskers 32 with a blind bore 26, throat 28, nozzle 30 assembly to receive a sustainer propellant. Any suitable propellant may be used as the sustainer propellant, such as HTPE (hydroxyl-terminated polyether) or HTPB (hydroxy-terminated polybutadiene). Any suitable igniter may be utilized to ignite the sustainer propellant. To avoid damage to the gun, the sustainer propellant is preferably ignited when the bullet exits the muzzle or very shortly before that moment. To maximize bullet speed to the target, the sustainer should provide sufficient thrust to at least equal aerodynamic drag for up to two kilometers of flight and nominally for about one kilometer of flight. The sustainer generates thrust to counteract wave drag and skin friction drag. The gases expelled by burning of the sustainer fill the void created by the vacuum at the base of the projectile overcoming base drag.

One igniter 34 supports the igniter behind the nozzle 30 at the rear of aft section 16. A primer charge 38, such as a mixture of boron potassium nitrate $BKNO_3$, and Duco Cement (mixture of 1-methoxy-2-propanol acetate, acetone, cellulose nitrate, isopropanol and camphor available from ITW Devcon, Danvers, Mass.) fills the nozzle 30 abutting a compressible sphere 40. When the bullet is fired, the chamber propellant generates a pressure compressing the compressible sphere 40 which ruptures when the argon has a temperature in excess of a desired minimum, such as 1500° F., igniting the primer charge 38 causing an intense flame front to ignite sustainer propellant 31.

Figure 7:
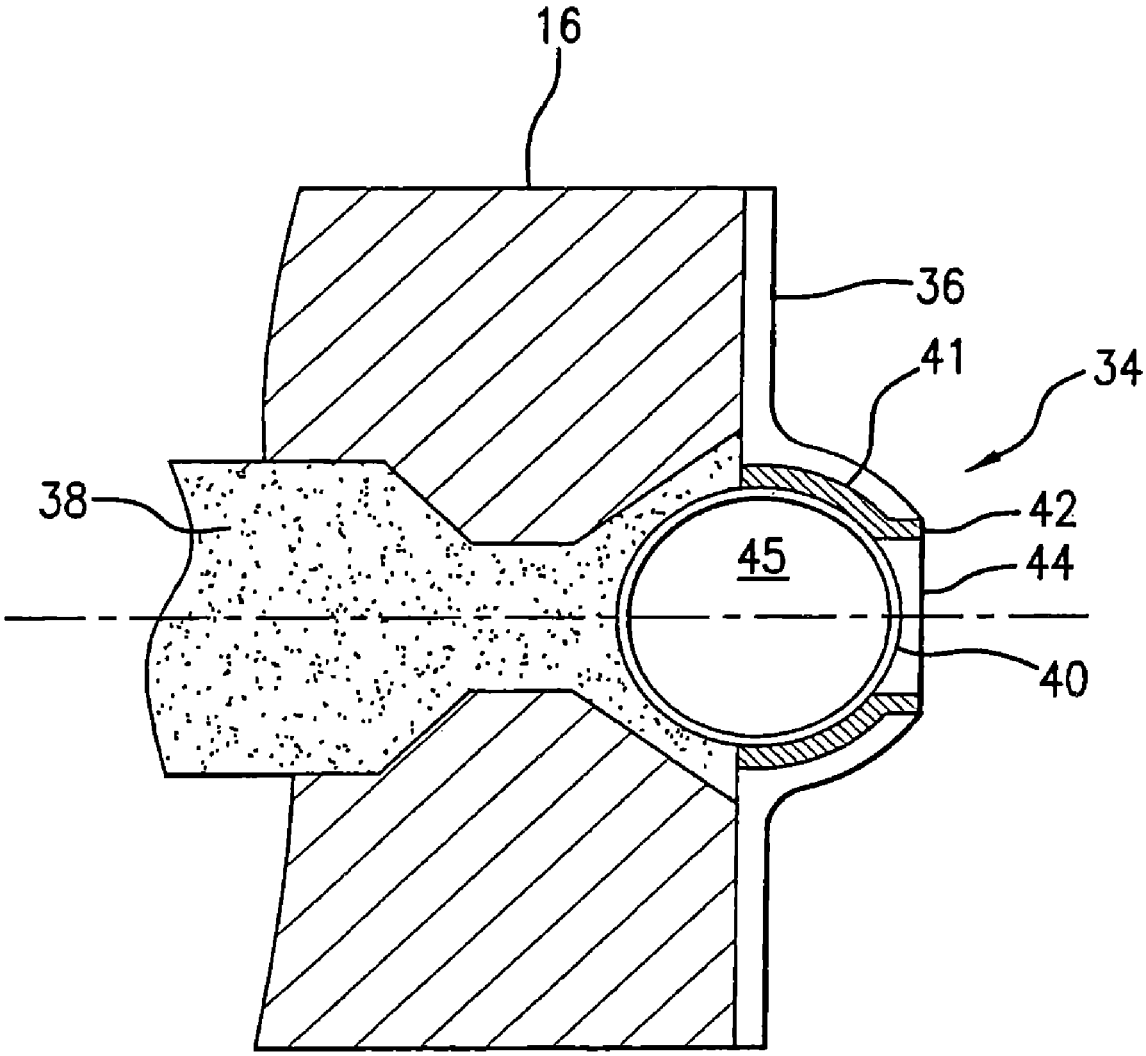
FIG. 7 illustrates an igniter for use with the second and fourth embodiment illustrated in FIGS. 4 and 6.

The portion of the igniter 34 is illustrated in FIG. 7. The retention plate 36 includes one or more apertures 41 with a plastic seat 42 lining at least one aperture to seat compressible sphere 40. A number of apertures 41, nominally from 1 to 6, contain a compressible sphere 40. When the gun is fired, the main propellant in the gun cartridge is ignited generating a pressure wave that presses on aft cap 44 compressing the compressible sphere 40 increasing the pressure of a gas 45 contained within the compressible sphere causing a gas temperature increase. The gas 45 should also be inert and non-hazardous. A preferred gas is argon. Once the collapse pressure is reached, the argon bursts through the fore cap 49 at a temperature of well above 1500° F. and ignites the sustainer propellant.

Figure 16:
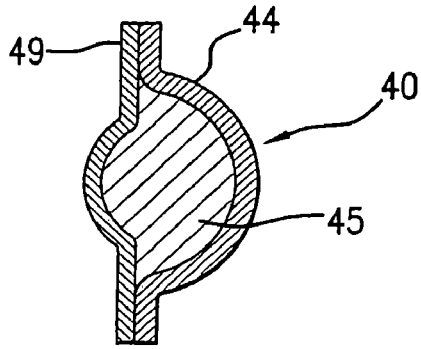
FIG. 16 is an enlarged view of a compressible bubble used with the igniter illustrated in FIG. 7.

Referring to FIG. 16, the compressible sphere 40 need not be spherical, merely spheroidal is acceptable. An exemplary compressible sphere is hermetic, on the order of 0.2 inch in diameter, and filled with a gas that has a significant temperature rise when compressed. The aft cap 44 may be welded to a fore cap 49 to hermetically retain argon gas 45. Suitable materials for the aft cap 44 and fore cap 49 are fully annealed metals such as aluminum or stainless steel or a weldable plastic. When the gun is fired, pressure generated by the cartridge propellant increases pressure exerted on aft cap 44. The compressible sphere 40 is designed to collapse at a predetermined critical pressure.

Figure 8:
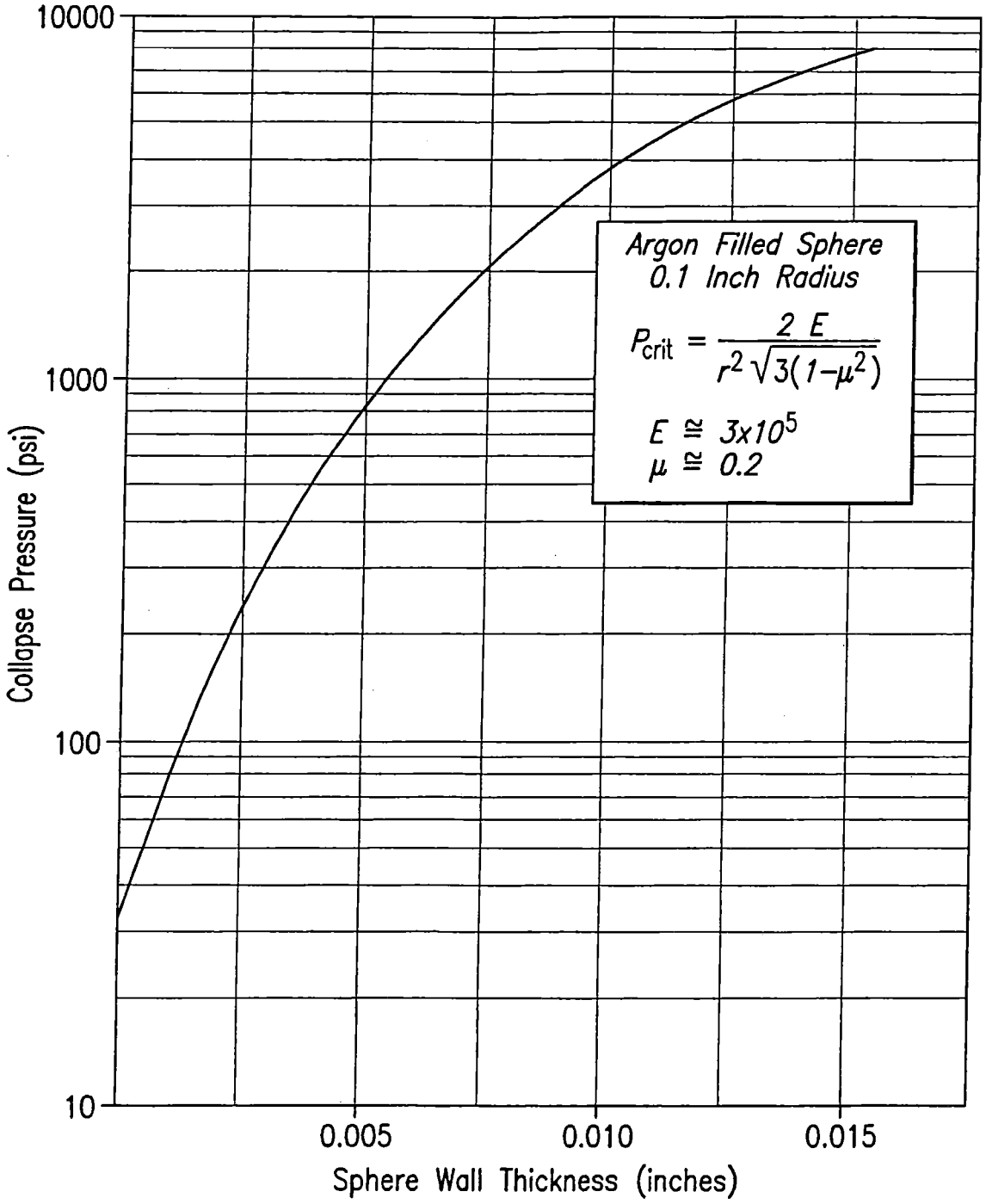
FIG. 8 graphically relates Collapse Pressure to Sphere Wall Thickness for the igniter of FIG. 7.

FIG. 8 graphically illustrates a relationship between the collapse pressure and the sphere wall thickness for a 0.2 inch diameter (0.1 inch radius) sphere formed from plastic with a variable wall thickness. In determining $P_{crit}$, E is (the Modulus of Elasticity) about $3\times10^5$ and $\mu$ is (Poisson's Ratio) about 0.2. The igniter can be designed for the spheres to burst at any desired pressure. An ideal collapse pressure is from 2000 psi to 5000 psi.

Figure 9:
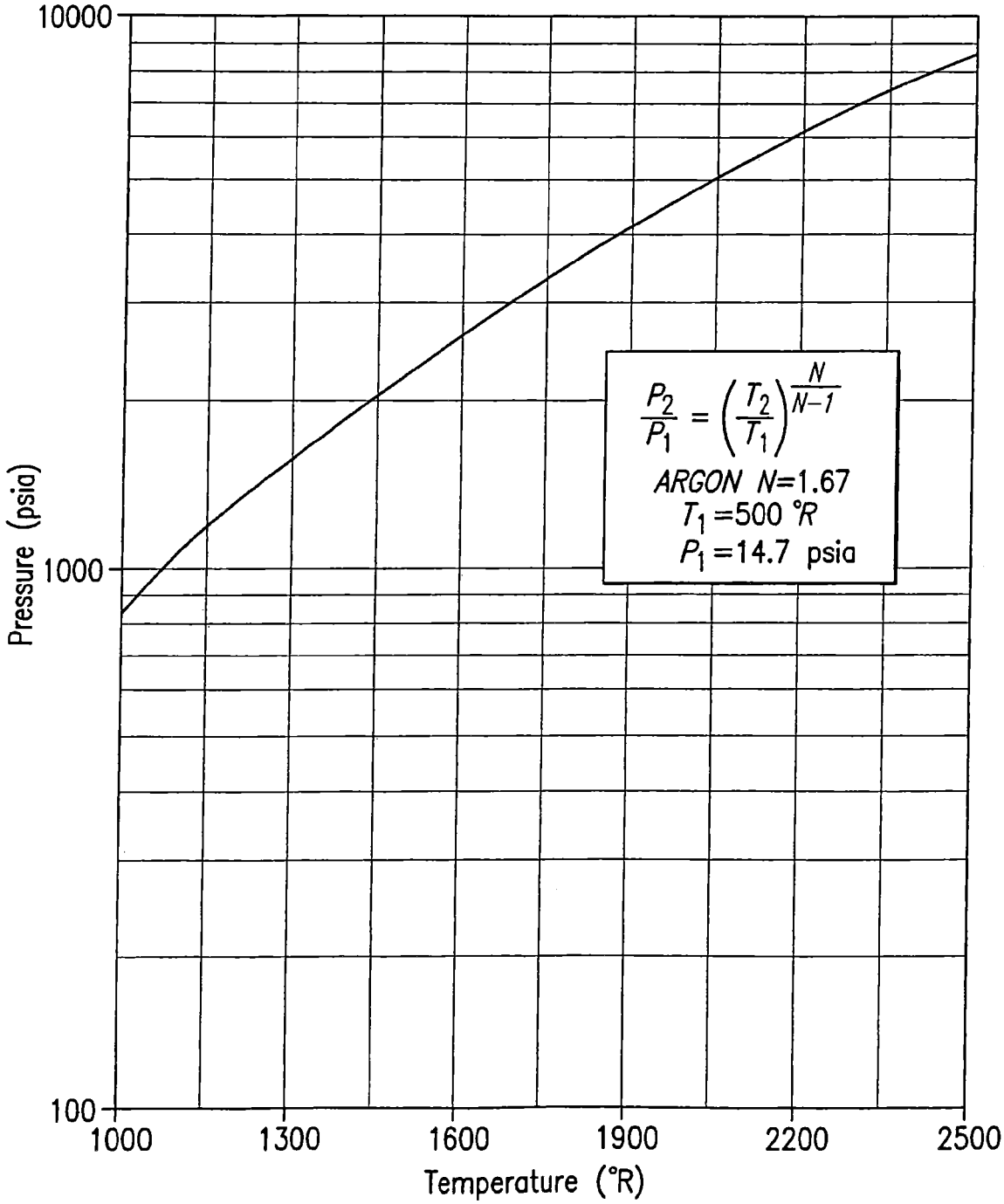
FIG. 9 graphically relates Collapse Pressure to Propellant Combustion Temperature for the igniter of FIG. 7.

FIG. 9 graphically illustrates a relationship between the collapse pressure and temperature of the argon at the collapse pressure. $P_1$ is atmospheric pressure, nominally 14.7 psi and $P_2$ is the collapse pressure as noted by the vertical axis of FIG. 9. $T_1$ is ambient temperature, nominally 500° R (40.3° F.) and $T_2$ is the argon temperature at the collapse pressure in ° R. N is a gas constant that is 1.67 for argon. The igniter utilizes the leading edge of the pressure wave from the cartridge propellant burn to ignite the sustainer propellant. Features of this igniter include its simplicity, requirement of a single igniter and no timer. Multiple bubbles may be utilized to uniformly distribute both the flame front and the pressure front.

Bubble Igniter 34 is small, safe and inert and useful to safely ignite propellant used as a booster or sustainer for gun launched rounds. This bubble igniter may be sized to operate effectively on round sizes from diameters as small as 0.15 inch (3.81 mm) to 0.5 caliber (12.7 mm) in hand held weapons of to guns of any size mounted on a vehicle or tank. The bubble igniter has no electrical connection or activation requirement. It is an inert nugget of argon or other appropriate gas stored at room temperature and modest pressure in one of a number of possible storage vessels. The nugget is nested within the propellant that requires ignition and can stay there indefinitely.

In a hand held weapon firing a small caliber round, the pressure in the gun barrel as it pushes the bullet along is on the order of 50,000 p.s.i. This pressure is communicated to the bullet in the form of acceleration which in turn raises the pressure in the main gun propellant and on the bubble, causing the bubble to collapse pressurizing the argon. As the pressure of the argon is increased, so is the temperature as shown in the PT curve of FIG. 9. Burn temperature of a typical sustainer propellant is on the order of 6500° F. At that temperature, the Carnot efficiency (a measure of the ability to change heat to mechanical energy) is about 20%, significantly higher than the 14% efficiency for average gun powder which burns at about 4500° F. This means that the Specific Impulse of the sustainer propellant, assuming a well designed nozzle, should be close to 250 seconds at sea level.

Figure 10:
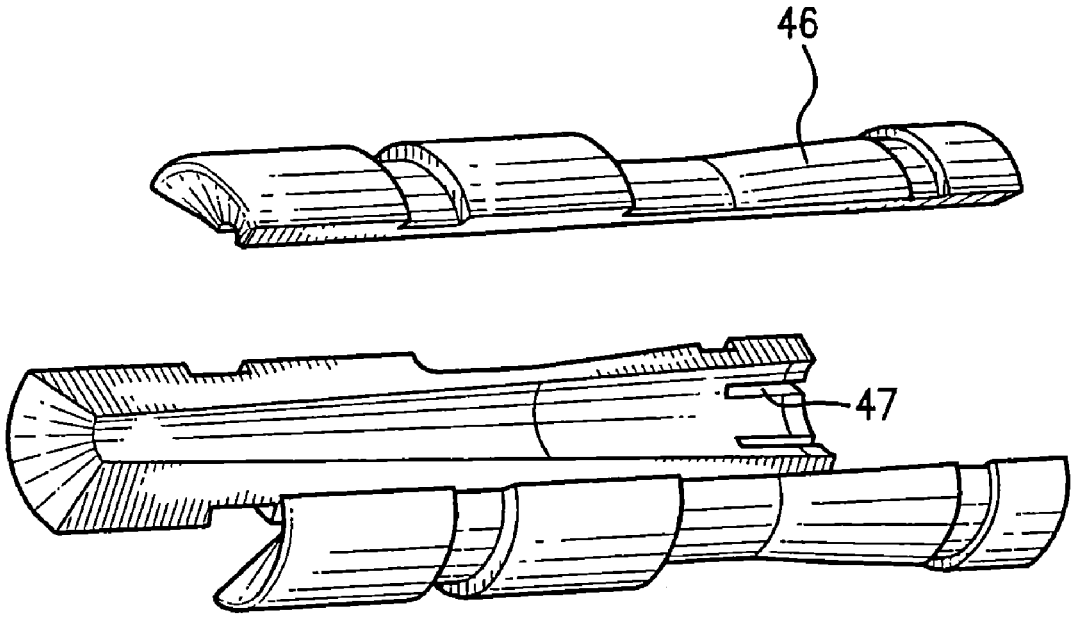
FIG. 10 is an exploded isometric view of sabot components for use with the sub-caliber bullets disclosed herein.

The disclosed bullet has an aspect ratio of at least 5:1 and is sub-caliber. To properly align the bullet in the gun and to maximize the pressure build-up behind the bullet, and thereby the velocity of the bullet exiting the gun muzzle, a sabot is employed. FIG. 10 illustrates in exploded isometric view, three 120° sabot segments 46 that may be assembled around the bullet. The sabot segments 46 may be formed from a molded composite body, such as carbon or glass filled plastic. A biodegradable plastic may be desired for environmental concerns. Suitable biodegradable plastics include polyglycolide, polyactic acid and poly-3-hydroxybutyrate.

Figure 11:
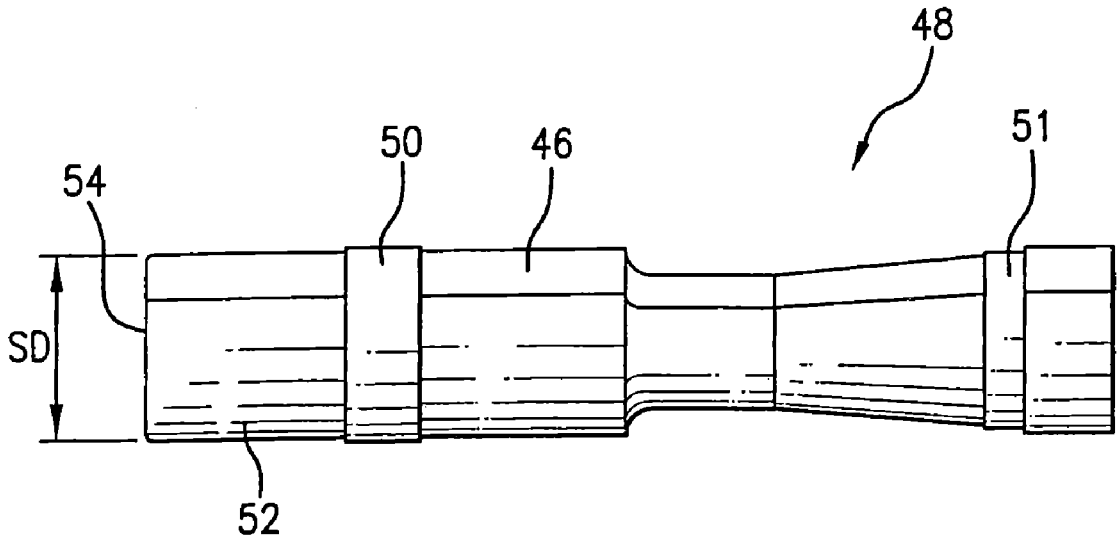
FIG. 11 is an isometric view of a sabot assembled from the components of FIG. 10.

When the aft portion of the bullet includes whiskers, slots 47 are included in the sabot segments 46 to accommodate those whiskers. FIG. 11 is an isometric view of the sabot segments 46 assembled to form a sabot 48 held together by a fore slip ring 50 and aft retention band 51. The fore slip ring restrains the sabot segments 46 and provides a gas seal. Typically, it is formed from a molded nylon, lubricant filled nylon or Teflon (trademark of DuPont of Wilmington, Del. for polytetrafluoroethylene). The fore slip ring can be a continuous band or a plurality of abutting arcuate segments. If the gun barrel is rifled, the fore slip ring has an outside diameter slightly larger than the sabot diameter (SD) to seal the rifling. As the fore slip ring 50 is not bonded to the sabot segments 46 and merely makes a loose friction fit, the high rate of spin imparted to the fore slip ring by the rifling is not imparted to the sabot/bullet. Rather, the sabot/bullet is either imparted with no spin or a slow rate of spin, on the order of 100 revolutions per second (rps).

The aft retention band 51 is a plastic band that may be formed from any easily breakable material such as nylon or polypropylene.

The sabot diameter (SD) at a front portion 52 of the sabot 48 is full caliber to provide a sliding fit and to align the bullet along the axis of the gun barrel. The front portion 52 is preferably at least twice the caliber in length to support the bullet during travel through the gun bore. Leading edge 54 of the front portion is shaped to enhance air resistance, the leading edge may present a flat surface or inwardly concave surface to maximize the stresses applied by the stagnation pressure of the air in front of the moving sabot/bullet. Thus, the sabot 48 breaks apart and separates from the bullet upon exiting the gun muzzle.

Figure 12:
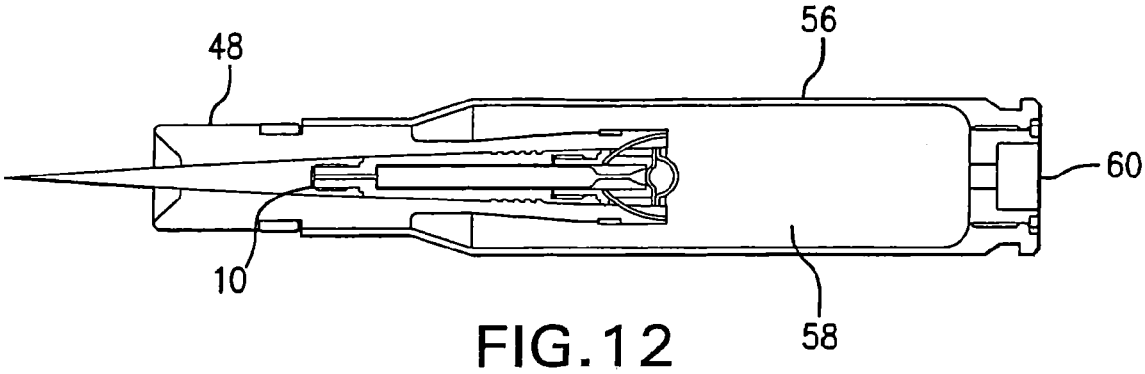
FIG. 12 is a cross-section view of the sub-caliber bullet disclosed herein having an attached sabot and loaded into a cartridge.
Figure 13:
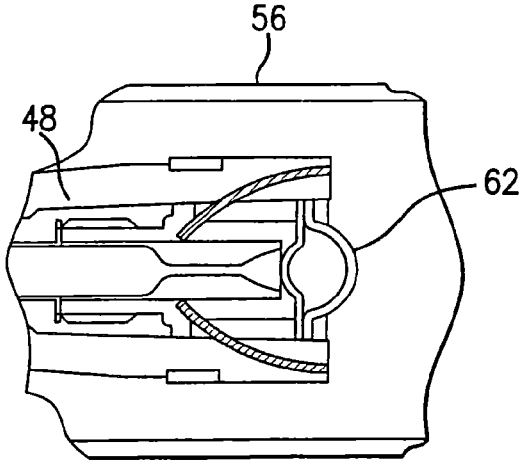
FIG. 13 is an enlarged view of the aft portion of the sub-caliber bullet as loaded into the cartridge of FIG. 12.

FIG. 12 illustrates the bullet 10/sabot 48 assembly loaded into a cartridge case 56. The cartridge case includes cartridge propellant 58 that is ignited by a primer 60 when the gun is fired. As best illustrated in the enlarged view of FIG. 13, a pressure front generated by cartridge propellant burn engages aft face of igniter 62 enabling ignition of the sustainer propellant when the desired pressure level is achieved.

Figure 14:
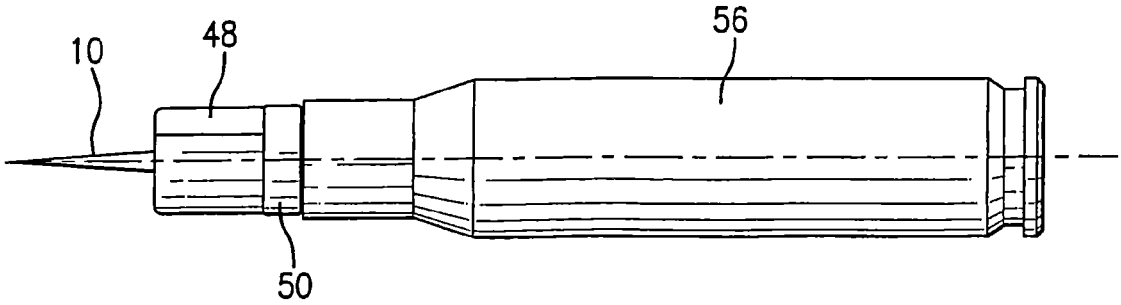
FIG. 14 is an isometric view of the sub-caliber bullet having an attached sabot and loaded into a cartridge that is illustrated in FIG. 12.

FIG. 14 is an isometric view of the bullet 10/sabot 48 assembly in cartridge 56.the fore slip ring is full caliber to engage rifling of the gun barrel, if present. While the bullet disclosed herein may be used with any small caliber gun, preferred calibers include .308 inch, .338 inch, 20 millimeter, 30 millimeter and .50 caliber.

While a sniper bullet has been described herein, other projectiles requiring accuracy over long distances, such as an anti-aircraft round will benefit.

The Bubble Igniter described above has a number of advantages over conventional igniters. It has reduced complexity and does not require electronics or a timer, thereby reducing cost. A plurality of bubbles in a single igniter smooth the flame/pressure front and increase the reliability of the sustainer burn.

While an electrical ignition system has been developed, it is costly and complex. The Bubble Igniter may achieve the same degree of repeatability but at much lower cost.

The Bubble igniter is also well suited to ignite incendiary devices intended to burn out pillboxes or other deep buried strong holds that require ignition of a solidly packed propellant to provide a high temperature, high energy density source.

EXAMPLE

Advantages of the bullet described herein may be better understood by the following prophetic Example:

In the table illustrated in FIG. 15, various bullet parameters are calculated by analytic methods and compared to properties of conventional bullets. The properties of the conventional bullets were determined by data published by ammunition companies. Significant improvements by the bullets disclosed herein are noted, particularly for muzzle velocity, bullet drop at 1 km and time of flight to target, as well as accuracy.

Test Data

In the table illustrated in FIG. 18, projectile impact and target crater results are shown for five shots using different projectiles and sabots. One projectile was made of 6061-T6 aluminum; the other projectiles were made from a mixture of materials. The target was a sample of rolled homogeneous armor (RHA) with dimensions of 200 mm×200 mm, 150 mm in thickness, with a nominal Brinell hardness number (BHN) of 269. The projectiles in shots 3 and 6, though of different composition, had similar average density ($\rho$=2.71 and 2.80 g/cm$^3$ respectively). These shots had very similar impact velocity and energy, and also had similar results with respect to target penetration and the crater formed in the target—the deepest penetrations and the largest crater volumes observed. These data indicate that the average density of the projectile is the most important factor in determining target penetration.

Bullet with Stabilized Flight

Figure 19A:
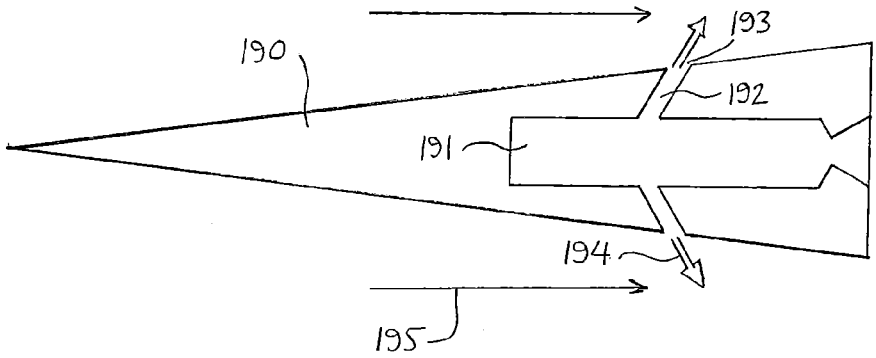
FIG. 19A is a cross-sectional view of a sub-caliber bullet with symmetrically arranged nozzles, in accordance with another embodiment of the disclosure.

In an additional embodiment, shown schematically in FIG. 19A, a bullet 190 has a bore 191 filled with a sustainer propellant. A plurality of channels 192 lead from the bore to the surface of the bullet, ending in aft-facing openings (nozzles) 193 for expelling sustainer propellant. The nozzles are arranged symmetrically about the longitudinal axis of the bullet. Jets of gas 194, expelled via nozzles 193 by burning the sustainer propellant, intercept the flow 195 of air moving past the bullet.

Figure 19B:
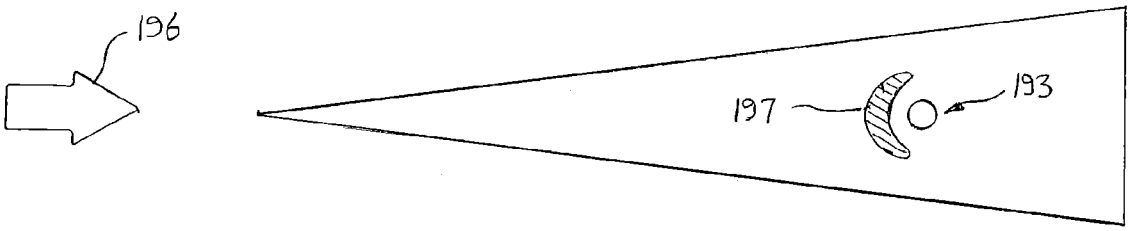
FIG. 19B schematically illustrates the effect of supersonic flow intercepting a jet from a nozzle in the bullet of FIG. 19A.

Bullet 190 typically travels through the air at a supersonic speed, so that relative to the bullet, a supersonic (high Mach number) flow is directed at the forward end of the bullet. As shown schematically in FIG. 19B, a high Mach number flow 196 is intercepted by a jet from nozzle 193. This results in an aerodynamic shock which creates a region 197 of high pressure on the surface of the bullet. Since the nozzles and jets are symmetric about the longitudinal axis of the bullet, a plurality of high-pressure regions are formed around the bullet which act as stabilizers without drag. In an embodiment, six nozzles are arranged symmetrically about the longitudinal axis in a ring to provide stable flight.

Bullet in Flight with Side Wind

When the bullet travels through air with a side wind, the wind velocity relative to the bullet is the vector sum of wind velocity $v_{axial}$ due to the motion of the bullet and side wind velocity $v_{wind}$. The resultant wind velocity $v_{new}$ is at a small angle to the axis of the bullet, so that the bullet encounters a wind at a small angle of attack.

A round embodying the disclosure has increased accuracy due to the aerodynamics of the bullet reacting to side wind forces and crabbing into the wind. When the flight body is flying to the target with the sustainer compensating for drag, the velocity of the round is constant and the drag force is exactly compensated by the force of the sustainer's thrust. If that weren't true, the bullet would either accelerate of decelerate (force=mass×acceleration). It is valid to think about the force of the drag as equivalent to the force of a wind blowing on the nose of the bullet at velocity $v_{axial}$. For the bullet, which is axially symmetric, to be stable, the center of mass will be aligned on this vector and be in front of the center of pressure, which will also be along the same vector. The sustainer thrust vector is pointing in the opposite direction and is also collinear.

Figure 20A:
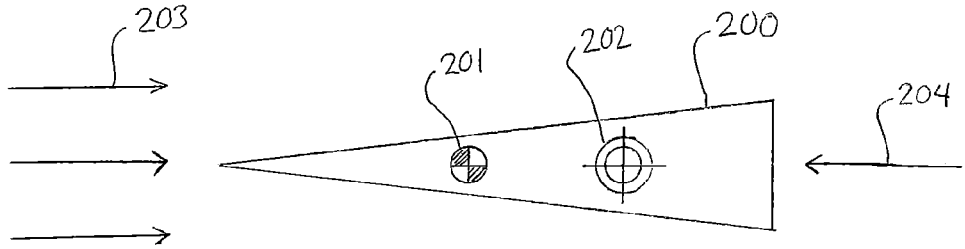
FIGS. 20A and 20B schematically illustrate the effect of sustainer propellant thrust on flight of a projectile without a side wind and in a side wind, respectively.

FIG. 20A illustrates a bullet 200 in flight, with center of mass 201 and center of pressure 202; the center of mass is forward of the center of pressure. The drag force 203, due to the apparent wind on the nose of the bullet in flight, is compensated by the sustainer thrust force 204

If a wind 210 blows from the side with velocity $v_{wind}$ (FIG. 20B), then the total equivalent wind velocity $v_{new}$ is the vector sum of $v_{axial}$ plus $v_{wind}$. This will be at a small angle off the axis of symmetry. Forces acting on the bullet may be thought of as applied at the center of pressure 202, while the bullet rotates about its center of mass 201. Because the flight body is aerodynamically stable, the bullet must swing around so that the nose is always pointing exactly into the wind along the vector $v_{new}$, in the manner of a weathervane. Since the sustainer thrust is aligned with the flight body, it must also swing around to be aligned with $v_{new}$ so that the thrust vector is in the direction 205. This causes a component 211 of the thrust vector to be pointing exactly opposite to that of the side wind $v_{wind}$ 210. Because the projectile is neither accelerating nor decelerating, this magnitude must be exactly matched too. At this point, the side force of the wind is exactly cancelled by the canted force of the sustainer. Since the net sideways force is zero, the round will not accelerate to the side. Given that the initial sideways velocity is zero, it will stay zero even as the wind blows.

Figure 20B:
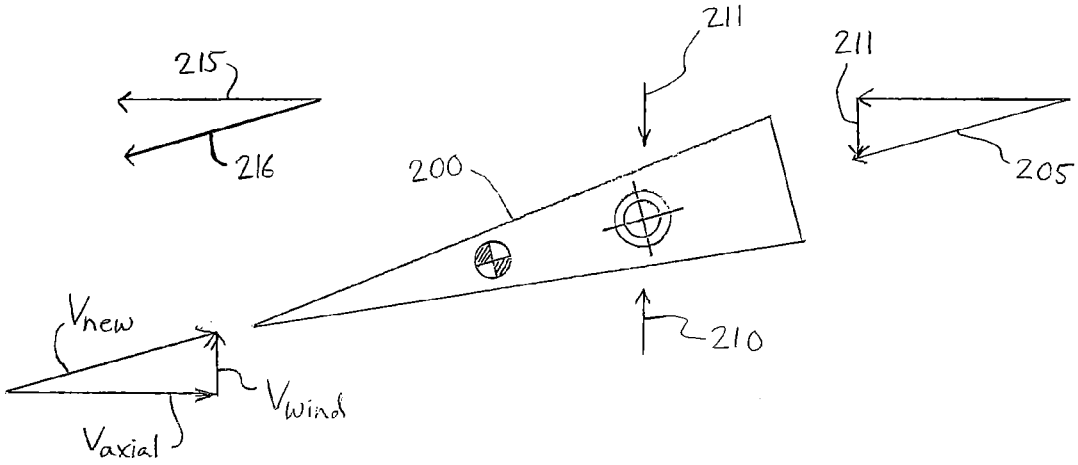

Thus, when the wind blows on a stable projectile moving at constant velocity due to a sustainer, the projectile axis will crab over slightly to point toward the wind but, amazingly enough, the projectile will continue to fly along its original course as if there were no wind. Referring to FIGS. 20A and 20B, projectile 200 in FIG. 20B will continue its flight in the same direction as in FIG. 20A (direction 215, the direction opposite vector 203), but with its nose pointed in direction 216. This effect has not been previously observed with application to sniper rounds. Since wind is the number one problem for snipers, this effect is very important.

One or more embodiments of the present invention have been described. Nevertheless, it will be understood that various modifications may be made without departing from the spirit and scope of the invention. For example, the use of a copper jacketed lead nose with an aerodynamic shape described herein. Accordingly, other embodiments are within the scope of the following claims.

What is claimed is:

1. A sub-caliber bullet having long-range accuracy, comprising:
- a forward portion, a mid-portion and an aft portion;
- said forward portion being a first material having a first density that is in excess of 10 g/cm$^3$ and said mid-portion being a second material having a second density that is less than said first density;
- said sub-caliber bullet having
  - a length, L, to maximum diameter, D, aspect ratio, L:D, of at least 5:1;
  - a diameter, d, of said forward portion and of said mid-portion satisfying an aerodynamic Power Law equation:

$$d=D*(x/L)^n$$

where x is a distance rearward from a nose of said sub-caliber bullet and n is a Power Law exponent that is between 0.5 and 0.75;
  - a center of pressure;
  - a center of gravity forward of the center of pressure;
  - a blind bore extending into said mid-portion from said aft portion and containing a sustainer propellant; and
  - a plurality of nozzles communicating the blind bore with an exterior surface of the bullet.

2. The sub-caliber bullet of claim 1, wherein the bullet has an average density in the range of about 2.7 g/cm$^3$ to about 2.8 g/cm$^3$.

3. The sub-caliber bullet of claim 1, wherein said plurality of nozzles are arranged symmetrically about the longitudinal axis of the bullet.

4. The sub-caliber bullet of claim 1, wherein jets of gas, expelled via the plurality of nozzles by burning the sustainer propellant, intercepting air flow past the bullet during flight are effective to create high pressure regions at the exterior surface of the bullet and thereby stabilize the flight.

5. The sub-caliber bullet of claim 1 wherein n is approximately 0.67.

6. The sub-caliber bullet of claim 5 wherein said forward portion is selected from the group consisting of copper-jacketed lead, tungsten, tantalum, alloys thereof and composites thereof.

7. The sub-caliber bullet of claim 6 wherein said aft portion has a plurality of outwardly and rearwardly extending whiskers symmetrically disposed about a circumference thereof.

8. The sub-caliber bullet of claim 1 wherein said aspect ratio, L:D, is approximately 10:1.

9. The sub-caliber bullet of claim 1, further comprising an igniter in flame communication with said sustainer propellant.

10. The sub-caliber bullet of claim 9 wherein said igniter includes at least one gas-filled frangible sphere, said frangible sphere having a wall thickness effective to burst at a desired pressure.

11. The sub-caliber bullet of claim 10 wherein said igniter further includes an orifice plate between said propellant and said aft portion with said at least one gas-filled frangible sphere attached to said orifice plate.

12. An ammunition round including a sub-caliber bullet having long range accuracy, comprising:
- a cartridge case filled with a cartridge propellant and having a bullet/sabot assembly partially inserted into an open end thereof;
- said sabot having a full caliber forward portion with a length effective to support said bullet; and
- said sub-caliber bullet having
  - a length, L, to maximum diameter, D, aspect ratio, L:D, of at least 5:1;
  - a diameter, d, of said forward portion and of said mid-portion satisfying an aerodynamic Power Law equation:

$$d=D*(x/L)^n$$

where x is a distance rearward from a nose of said sub-caliber bullet and n is a Power Law exponent that is between 0.5 and 0.75;
  - a center of pressure;
  - a center of gravity forward of the center of pressure;
  - a blind bore extending into said mid-portion from said aft portion and containing a sustainer propellant; and
  - a plurality of nozzles communicating the blind bore with an exterior surface of the bullet.

13. The ammunition round of claim 12, wherein the bullet has an average density in the range of about 2.7 g/cm$^3$ to about 2.8 g/cm$^3$.

14. The ammunition round of claim 12, wherein said plurality of nozzles are arranged symmetrically about the longitudinal axis of the bullet.

15. The ammunition round of claim 12, wherein jets of gas, expelled via the plurality of nozzles by burning the sustainer propellant, intercepting air flow past the bullet during flight are effective to create high pressure regions at the exterior surface of the bullet and thereby stabilize the flight.

16. The ammunition round of claim 12 wherein said sabot is formed from a plurality of segments held together by at least one slip ring that circumscribes said forward portion of said sabot and engages said sabot in a loose friction fit.

17. The ammunition round of claim 16 wherein said aft section of said bullet has a plurality of outwardly and rearwardly extending whiskers symmetrically disposed about a circumference thereof.

18. The ammunition round of claim 16 wherein said Power Law exponent, n, is approximately 0.67.

19. The ammunition round of claim 12, wherein said sub-caliber bullet further includes an igniter in flame communication with said sustainer propellant, and said igniter is effective to ignite said sustainer propellant after said bullet exits a gun muzzle.

20. The ammunition round of claim 17 wherein said igniter includes at least one gas-filled frangible sphere, said frangible sphere having a wall thickness effective to burst at a desired pressure.

* * * * *